US007124476B2

(12) United States Patent
Garofalo et al.

(10) Patent No.: US 7,124,476 B2
(45) Date of Patent: Oct. 24, 2006

(54) BUCKLE FOR TENSIONING THE STRAPS OF FINS OR THE LIKE, HAVING QUICK AND SIMPLE FASTENING AND UNFASTENING MEANS

(75) Inventors: Giovanni Garofalo, Rapallo (IT); Gian Paolo Vaccaro, Rapallo (IT)

(73) Assignee: HTM Sport S.p.A.(IT)

( * ) Notice: Subject to any disclaimer, the term of this patent is extended or adjusted under 35 U.S.C. 154(b) by 22 days.

(21) Appl. No.: 11/120,998

(22) Filed: May 4, 2005

(65) Prior Publication Data

US 2005/0246868 A1 Nov. 10, 2005

(30) Foreign Application Priority Data

May 5, 2004 (IT) ..... GE04A0036

(51) Int. Cl.
*A43C 11/14* (2006.01)
*A43C 11/00* (2006.01)

(52) U.S. Cl. ..... 24/71 SK; 24/68 SK

(58) Field of Classification Search ..... 24/68 SK, 24/656, 69 SK, 567, 70 SK, 68 T, 68 J, 68 CD, 24/70 J, 68 E, 265 WS, 265 B, 265 R, 652–654, 24/71 R–71 SD; 36/50.1, 50.5; 441/60–64; 280/14.21, 607, 14.22, 617, 618, 623, 632–634; 292/163, DIG. 11, DIG. 37, 61
See application file for complete search history.

(56) References Cited

U.S. PATENT DOCUMENTS 1,764,440 A * 6/1930 Gammell et al. ..... 24/68 J
1,985,835 A * 12/1934 Prestinari ..... 24/71 J
3,678,540 A * 7/1972 Graup ..... 24/70 SK
4,330,905 A 5/1982 Wolfgang
4,987,653 A * 1/1991 Lin ..... 24/68 CD
5,172,454 A * 12/1992 Martignago ..... 24/68 SK
5,237,759 A * 8/1993 Chaigne ..... 36/50.5
5,501,023 A * 3/1996 Miotto ..... 36/50.5
5,526,555 A * 6/1996 Battistella et al. ..... 24/68 SK
5,909,850 A * 6/1999 Cavasin et al. ..... 24/71 SK
6,163,941 A * 12/2000 Lai ..... 24/593.11
6,347,436 B1 * 2/2002 Barber et al. ..... 24/68 SK
6,374,464 B1 * 4/2002 Lai ..... 24/68 SK

FOREIGN PATENT DOCUMENTS

EP 0 687 484 12/1995
JP 2003259905 9/2003

* cited by examiner

*Primary Examiner*—Robert J. Sandy
*Assistant Examiner*—Ruth C. Rodriguez
(74) *Attorney, Agent, or Firm*—Stites & Harbison PLLC; Marvin Petry

(57) ABSTRACT

Buckle for tensioning the straps of fins or the like, having quick and simple fastening and unfastening means, comprising a base part designed to be attached to one side of the shoe of the fin, an intermediate lever hinged at one end by hinge pins to the said base part, and a terminal part which carries at one end the means of connection to the fin attachment strap, while its other end is hinged by the pins at a point on the said lever situated between the end hinged to the base part and its free end, characterized in that the lever possesses on its two flanks, near its free end, two elastically flexible wings, each having a tooth and an outwardly projecting pin, while the base is provided, likewise on each flank, in positions corresponding to the said teeth and to the said pins, with means for engaging with the said teeth, and for housing the said pins.

6 Claims, 2 Drawing Sheets

BUCKLE FOR TENSIONING THE STRAPS OF FINS OR THE LIKE, HAVING QUICK AND SIMPLE FASTENING AND UNFASTENING MEANS

BACKGROUND AND SUMMARY OF THE INVENTION

The present invention relates to buckles for tensioning the straps of swimming fins of the type with an open shoe.

Known buckles, such as those of the type illustrated in European Patent Application No. 687484 also by this applicant, essentially comprise a base part designed to be attached to one side of the shoe of the fin, an intermediate lever hinged at one end to the said base part, and a terminal part which carries at one end the means of connection to the said strap, while its other end is hinged at a point on the said lever situated between the end hinged to the base part and its free end.

One of the disadvantages of these known buckles for tensioning the straps of fins is that they are not always easy to unfasten, as in order to unfasten the said buckles a finger of one hand has to pull the lever away from the end of the base part. In the conditions in which the diver finds himself, especially if wearing gloves, this can cause problems. Again, the height, in other words effectively the overall size, of these buckles is considerable, enough space having to be provided in the buckle for the user to insert a finger.

In addition, there are even problems with fastening known buckles, it often happening that the lever pulling the buckle unfastens itself of its own accord, creating problems for the user.

The object of the present invention is therefore a buckle for tensioning the straps of open-shoe swimming fins that obviates the problems discussed above in respect of known buckles.

According to a main aspect of the invention, the said buckle comprises a base part designed to be attached to one side of the shoe of the fin, an intermediate lever hinged at one end by hinge pins to the said base part, and a terminal part which carries at one end the means of connection to the fin attachment strap, while its other end is hinged by the pins at a point on the said lever situated between the end hinged to the base part and its free end, characterized in that the lever possesses on its two flanks, near its free end, two elastically flexible wings, each having a tooth and an outwardly projecting pin, while the base is provided, likewise on each flank, in positions corresponding to the said teeth and to the said pins, with means for engaging with the said teeth, and for housing the said pins.

BRIEF DESCRIPTION OF THE DRAWINGS

Other features and advantages of the buckle according to the present invention will become more apparent in the course of the following description of a preferred embodiment thereof, illustrated by way of non-restrictive example in the accompanying drawing, in which.

DESCRIPTION OF THE PREFERRED EMBODIMENT OF THE INVENTION

Figure 1:
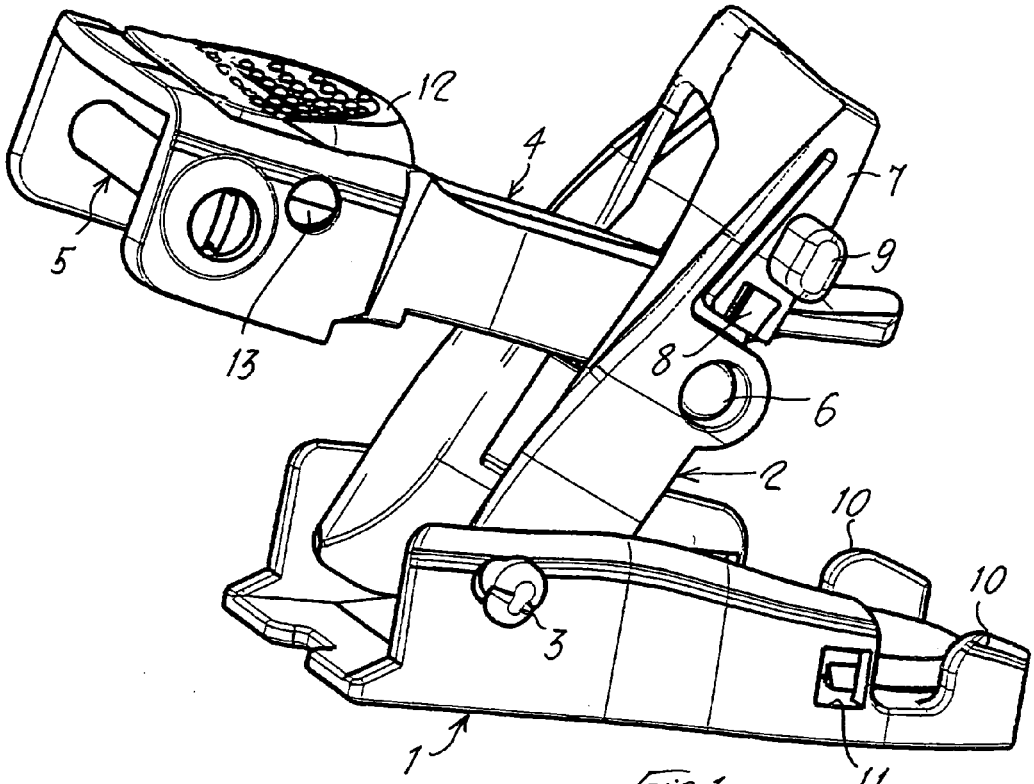
FIG. 1 illustrates a buckle according to the invention in the unfastened position.
Figure 2:
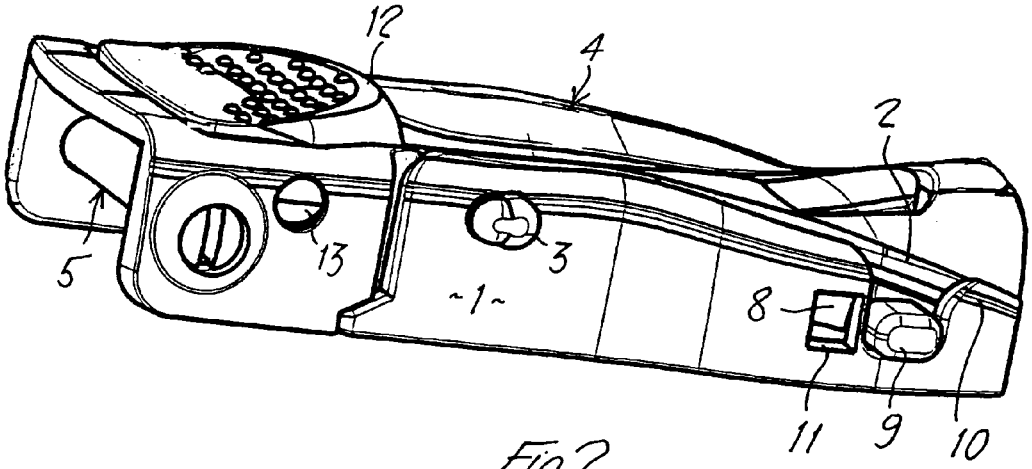
FIG. 2 illustrates the same buckle in the fastened position.

Referring initially to the buckle illustrated in FIGS. 1 and 2, the illustrated buckle comprises, exactly as in known buckles, a base part 1 designed to be attached to one side of the shoe of the fin (not illustrated), an intermediate lever 2 hinged at one end by hinge pins 3 to the said base part 1 and a terminal part 4 which carries at one end the means 5 of connection to the fin attachment strap (not illustrated), with a locking button 12, pivoting on the pin 13, for locking the strap in the desired adjustment position, while its other end is hinged by the pins 6 at a point on the said lever 2 situated between the end hinged to the base part 1 and its free end.

The lever 2 possesses on its two flanks, near its free end, two elastically flexible wings 7, advantageously formed integrally with the flanks of this lever 2, having at the ends a wedge-shaped tooth 8 and on an intermediate part thereof an outwardly projecting pin 9.

The base 1 is provided in turn, on each flank, in positions corresponding to the pins 9, with a recess 10 while in a position corresponding to the tooth 8 it has a hole 11.

The operation of the buckle described will be obvious.

With the buckle in the condition shown in FIG. 2, i.e. in the locked position, the teeth 8 are in the holes 11, so the levers 2 and 4 are locked in the functional or buckle-locked position.

To unlock the buckle, with the straps attaching the fin to the heel in the slackened position, the thumb and index finger of the hand apply pressure to the pins 9 so that the elastic arms 7 bend inwards, and the teeth 8 carried at the ends of the said arms come out of the holes 11, thereby disengaging the levers 2 and 4 and enabling them to rotate into the position of extension shown in FIG. 1.

The buckle can be returned to the locked position simply by exerting pressure on the lever 2 towards the base part 1.

DESCRIPTION OF ANOTHER EMBODIMENT OF THE INVENTION

Figure 3:
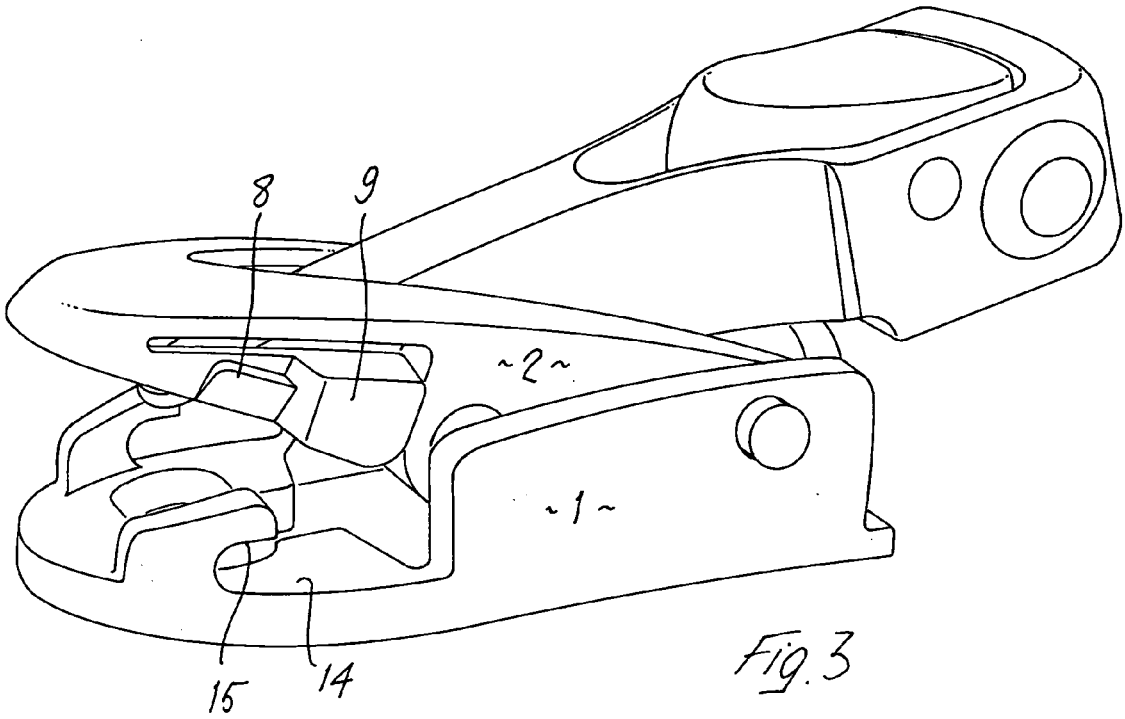
FIG. 3 illustrates a buckle in a variant of the invention, in the unfastened position.
Figure 4:
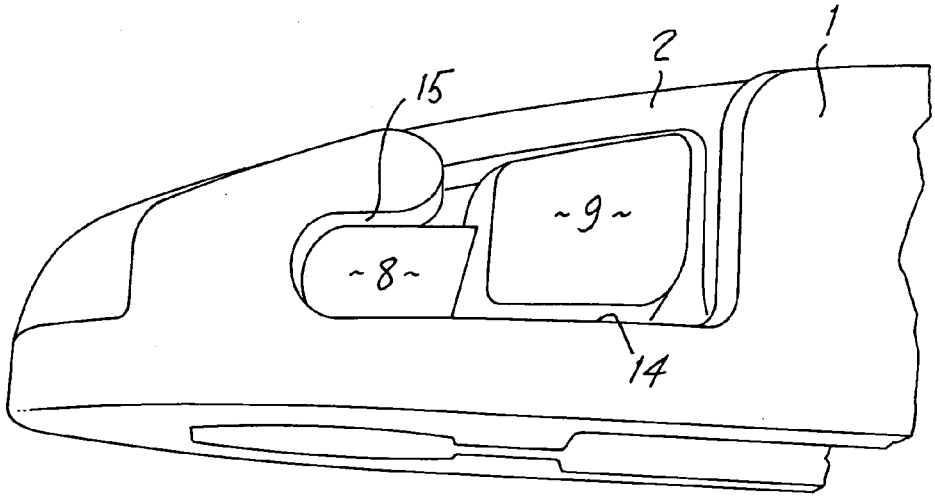
FIG. 4 illustrates the same buckle in the fastened position.

Naturally, the present invention is not limited to the buckle embodiment illustrated and described. For example, FIGS. 3 and 4 show a variant of the same buckle.

In this variant, a single long recess 14, having a C-shaped portion 15 at one end. The operation of this embodiment will be obvious. When the part 2 is swung down, the tooth 8 becomes locked, due to its wedge shape, beneath the upper extension of the portion 15, while the pin 9 rests in the recess 14. To release the buckle, the pin 9 is pushed in until the tooth 8 clears the portion 15.

The buckle according to the invention therefore comprises all such modifications and variants as come within the broader scope of the inventive concept, essentially as claimed below.

The invention claimed is:

1. Buckle for tensioning the straps of fins, having quick and simple fastening and unfastening means, comprising a base part designed to be attached to one side of a shoe of the fin, an intermediate lever hinged at one end by hinge pins to said base part, and a terminal part which carries at one end means of connection to a fin attachment strap, while its other end is hinged by pins at a point on said lever situated between the end hinged to the base part and its free end, characterized in that the lever possesses on its two flanks, near its free end, two elastically flexible wings, each having a tooth and an outwardly projecting pin, while the base is provided, likewise on each flank, in positions corresponding to said teeth and to said pins, with means for engaging with said teeth, and for housing said pins.

2. Buckle according to claim 1, in which said means for engaging with said teeth are holes.

3. Buckle according to claim 1, in which said means for engaging with said teeth are short crossbars.

4. Buckle according to claim 1, in which said means for housing said pins are upwardly open recesses.

5. Buckle according to claim 1, in which said teeth have a wedge profile in longitudinal section.

6. Buckle according to claim 1, in which said flexible wings are formed integrally with the flanks of said lever.

* * * * *